US008613269B2

(12) United States Patent
Shehter et al.

(10) Patent No.: US 8,613,269 B2
(45) Date of Patent: Dec. 24, 2013

(54) INTERNAL COMBUSTION ENGINE WITH DIRECT AIR INJECTION

(76) Inventors: Pavel Shehter, Givat Zeev (IL); Seva Brodsky, Jerusalem (IL)

( * ) Notice: Subject to any disclaimer, the term of this patent is extended or adjusted under 35 U.S.C. 154(b) by 0 days.

(21) Appl. No.: 13/427,942

(22) Filed: Mar. 23, 2012

(65) Prior Publication Data

US 2012/0285415 A1 Nov. 15, 2012

Related U.S. Application Data

(60) Provisional application No. 61/511,571, filed on Jul. 26, 2011, provisional application No. 61/483,915, filed on May 9, 2011, provisional application No. 61/483,952, filed on May 9, 2011, provisional application No. 61/381,948, filed on Sep. 11, 2010.

(51) Int. Cl.

| | |
|---|---|
| ***F02B 53/06*** | (2006.01) |
| ***F02B 53/00*** | (2006.01) |
| ***F02B 53/10*** | (2006.01) |
| ***F02B 23/00*** | (2006.01) |
| ***F02M 23/00*** | (2006.01) |
| ***F02B 5/00*** | (2006.01) |
| ***F01C 1/16*** | (2006.01) |
| ***F04C 18/00*** | (2006.01) |
| ***F04C 2/00*** | (2006.01) |
| ***F01C 1/18*** | (2006.01) |

(52) U.S. Cl.

USPC ..... 123/202; 123/204; 123/205; 123/206; 123/207; 123/585; 123/533; 123/305; 418/201.1; 418/201.2; 418/206.5

(58) Field of Classification Search

CPC ..... F02B 53/00; F02B 53/02; F02B 53/04; F02B 37/00; F02B 2730/05; F04C 18/084; F04C 18/16; F04C 29/04; F01C 1/123; F01C 11/008; F02D 41/0007; F02D 33/446

USPC ..... 123/202, 204, 205, 206, 207, 585, 533, 123/305; 418/201.1, 201.2, 206.5, 152, 28; 60/39.34

See application file for complete search history.

(56) References Cited

U.S. PATENT DOCUMENTS 2,048,134 A 7/1936 Montalto et al.
2,627,161 A * 2/1953 Lindhagen et al. ..... 418/201.1

(Continued)

FOREIGN PATENT DOCUMENTS

DE 2308194 A * 8/1974 ..... F04C 17/12
JP 59101539 A * 6/1984 ..... F02B 37/00

(Continued)

*Primary Examiner* — Thai Ba Trieu

(57) ABSTRACT

An internal combustion engine is provided. The engine comprises at least one combustion chamber. The engine is suitable for various types of fuel. The engine, depending on fuel type, may have at least one spark plug. The engine uses an external source of compressed oxidant, such as air, which is delivered from a compressor and/or pressurized storage tank. Compressed oxidant, such as air, is delivered directly into the combustion chamber. Fuel is delivered directly into the combustion chamber. Oxidant and fuel mixture is ignited either by means of a spark plug, laser ignition, or by other means, or ignites spontaneously, depending on fuel type and pressure in the combustion chamber. The engine may comprise at least one cylinder, or may be of rotary or other type. A hybrid vehicle based on such an engine is provided. An automatic parking system for such a vehicle is provided.

8 Claims, 11 Drawing Sheets

(56) References Cited

U.S. PATENT DOCUMENTS

| | | | | | |
|---|---|---|---|---|---|
| 2,725,043 | A | | 11/1955 | Bacot | |
| 2,857,902 | A | | 10/1958 | Van Vorst | |
| 3,302,868 | A | * | 2/1967 | Wrede | 418/206.5 |
| 3,527,548 | A | * | 9/1970 | Grant et al. | 418/201.2 |
| 3,584,984 | A | * | 6/1971 | Majkowski et al. | 418/28 |
| 3,656,879 | A | * | 4/1972 | De Vries, Jr. | 431/349 |
| 3,980,152 | A | | 9/1976 | Manor | |
| 4,106,472 | A | | 8/1978 | Rusk | |
| 4,202,315 | A | | 5/1980 | Lutrat | |
| 4,383,589 | A | | 5/1983 | Fox | |
| 4,478,304 | A | | 10/1984 | Delano | |
| 4,596,119 | A | | 6/1986 | Johnson | |
| 4,741,164 | A | | 5/1988 | Slaughter | |
| 4,776,306 | A | | 10/1988 | Matsuura et al. | |
| 4,782,801 | A | | 11/1988 | Ficht et al. | |
| 4,794,901 | A | * | 1/1989 | Hong et al. | 123/533 |
| 4,858,577 | A | | 8/1989 | Matsuura et al. | |
| 4,989,558 | A | | 2/1991 | Coates | |
| 5,230,314 | A | | 7/1993 | Kawahara et al. | |
| 5,249,557 | A | * | 10/1993 | Katoh et al. | 123/305 |
| 5,287,829 | A | | 2/1994 | Rose | |
| 5,310,320 | A | * | 5/1994 | Timuska | 418/152 |
| 5,460,239 | A | | 10/1995 | Jensen | |
| 5,535,715 | A | | 7/1996 | Mouton | |
| 5,895,210 | A | * | 4/1999 | Nakaniwa et al. | 418/206.5 |
| 6,045,343 | A | * | 4/2000 | Liou | 418/201.1 |
| 6,363,723 | B1 | | 4/2002 | Negre et al. | |
| 6,752,131 | B2 | | 6/2004 | Poola et al. | |
| 6,907,723 | B1 | * | 6/2005 | Haskins | 60/39.34 |
| 6,962,137 | B2 | | 11/2005 | Udy | |
| 6,988,482 | B2 | * | 1/2006 | Lockett | 123/202 |
| 7,121,247 | B2 | | 10/2006 | Lee | |
| 7,328,680 | B1 | | 2/2008 | Diamond | |
| 7,789,181 | B1 | | 9/2010 | Schechter | |
| 7,802,550 | B2 | | 9/2010 | Dirker | |
| 2008/0314342 | A1 | | 12/2008 | Pattakos et al. | |
| 2009/0084366 | A1 | * | 4/2009 | Gachik et al. | 123/585 |
| 2010/0000491 | A1 | | 1/2010 | Tinder | |

FOREIGN PATENT DOCUMENTS

| | | | | | |
|---|---|---|---|---|---|
| JP | 02095766 | A | * | 4/1990 | F02M 33/00 |
| RU | 2083383 | C1 | * | 7/1997 | B60K 6/04 |
| WO | WO 03058045 | A1 | * | 7/2003 | F02B 53/00 |
| WO | WO 2005124105 | A1 | * | 12/2005 | F02B 53/00 |

* cited by examiner

INTERNAL COMBUSTION ENGINE WITH DIRECT AIR INJECTION

CROSS-REFERENCE TO RELATED APPLICATIONS

This application claims the benefit under 35 USC §119(e) of U.S. Provisional Application No. 61/511,571 filed Jul. 26, 2011 and titled "Internal combustion engine with direct air injection and hybrid vehicle based thereupon"; U.S. Provisional Application No. 61/483,915 filed May 9, 2011 and titled "Internal combustion engine with direct injection of air and fuel"; U.S. Provisional Application No. 61/483,952 filed May 9, 2011 and titled "Rotary internal combustion engine"; and U.S. Provisional Application No. 61/381,948 filed Sep. 11, 2010 and titled "Mechanism of the gas distribution of internal combustion engine."

BACKGROUND OF THE INVENTION

This invention pertains to the field of internal combustion engines. Presently, the internal combustion engines being manufactured generally suffer from a plethora of problems, such as excessive weight and size, low efficiency, low power-to-weight ratio, low torque, high fuel consumption, high levels of air pollution, excessive noise and vibration, high complexity and large number of parts, which leads to decreased reliability and durability of the engine. The present invention endeavors to solve these problems to some extent, improving the relevant parameters substantially.

US PATENT REFERENCES

U.S. Pat. No. 2,048,134, Rotary valve gear for internal combustion engines, Montalto et al., 1936

U.S. Pat. No. 2,725,043, Rotary spherical internal combustion engine valve, Bacot, 1955

U.S. Pat. No. 2,857,902, Rotary device for the distribution of fluids into and from the cylinders of driving or working reciprocating machines, Van Worst, 1958

U.S. Pat. No. 3,980,152, Air powered vehicle, Manor, 1976

U.S. Pat. No. 4,106,472, Rotary energy converter with respiring chambers, Rusk, 1978

U.S. Pat. No. 4,202,315, Single cycle rotary engine with constant fuel feeding, Lutrat, 1980

U.S. Pat. No. 4,383,589, Pneumatic drive system for land vehicles, Fox, 1983

U.S. Pat. No. 4,478,304, Compressed air power engine, Delano, 1984

U.S. Pat. No. 4,596,119, Compressed air propulion system for a vehicle, Johnson, 1986

U.S. Pat. No. 4,741,164, Combustion engine having fuel cut-off at idle speed and compressed air starting and method of operation, Slaughter, 1988

U.S. Pat. No. 4,776,306, Valve operating system for internal combustion engine, Matsuura et al., 1988

U.S. Pat. No. 4,782,801, Internal combustion motor, Ficht et al., 1988

U.S. Pat. No. 4,858,577, Rotary valve device for internal combustion engines, Matsuura et al., 1989

U.S. Pat. No. 4,989,558, Spherical rotary valve assembly for an internal combustion engine, Coates, 1991

U.S. Pat. No. 5,230,314, 4-Cycle engine, Kawahara et al., 1993

U.S. Pat. No. 5,287,829, Fluid actuators, Rose, 1994

U.S. Pat. No. 5,460,239, Air compressor based vehicle drive system, Jensen, 1995

U.S. Pat. No. 5,535,715, Geared reciprocating piston engine with spherical rotary valve, Mouton, 1996

U.S. Pat. No. 6,363,723, Method and device for reaccelerating a vehicle equipped with high-pressure air compressors, Negre et al., 2002

U.S. Pat. No. 6,752,131, Electronically-controlled late cycle air injection to achieve simultaneous reduction of NOx and particulates emissions from a diesel engine, Poola et al., 2004

U.S. Pat. No. 6,962,137, Two-cycle rotary engines, Udy, 2005

U.S. Pat. No. 7,121,247, Spherical rotary engine valve assembly, Lee, 2006

U.S. Pat. No. 7,328,680, Cylinder head assembly and spherical valve for internal combustion engines, Diamond, 2008

U.S. Pat. No. 7,789,181, Operating a plug-in air-hybrid vehicle, Schechter, 2010

U.S. Pat. No. 7,802,550, Cylinder head arrangement including a rotary valve, Dirker, 2010

US PATENT APPLICATION REFERENCES

20080314342, Desmodromic variable valve actuation, Pattakos et al., 2008

20100000491, Rotary engines, systems and methods, Tinder, 2010

FOREIGN PATENT REFERENCES

WO/2003/058045, Two-process rotary internal combustion engine, Krajnovic, 2003

WO/2005/124105, Rotary machine and internal combustion engine, Olofsson, 2005

OTHER PUBLICATIONS

Grünefeld, G., Knapp, M., Beushausen, V., and Andresen, P., "Direct Air Injection for Substantial Improvement of SI Engine Cold Start Performance," SAE paper 971069, 1997

Siuru, W. D., Jr. "Automotive Superchargers and Turbochargers," Handbook of Turbomachinery, 2003 (2nd ed)

Siuru, W. D., Jr. "Why We Want to Plug In Our Cars," www.GreenCar.com, 2007

Müller, B., Deutscher, J., Grodde, S., Giesen, F., and Roppenecker, G., "Universal Trajectory Planning for Automatic Parking," ATZ Worldwide eMagazines, 2007

Mickelson, P., "Why 2-Stroke Direct Injection is a Big Deal," Snow Goer, October 2008 "Clean, economical engines to cut greenhouse gas emissions," PSA Peugeot Citroën, 2011

BRIEF SUMMARY OF THE INVENTION

The principal objects of the present invention are: to provide an improved internal combustion engine; to also provide an engine of greatly improved efficiency, higher output power to weight ratio, and improved torque capabilities; to also provide such an engine, which utilizes an external air compressor and/or compressed air reservoir to inject compressed air directly into the combustion cavity, obviating the need for intake valves; to also provide such an engine, which utilizes spherical pivoting intake and/or exhaust valves; to also provide an engine which avoids the reciprocation of relatively large masses therein, thereby avoiding the conversion of the linear movement to rotary movement with the goal of improving fuel efficiency and reducing vibrations; to also provide such an engine with fewer parts and without the need for complex types of valve mechanisms, which are required in conventional reciprocating engines; to also provide a rotary engine including a lobed rotor or a rotor with retracting vanes; to also provide a rotary engine with a pluraliry of rotors; to also provide an engine, which can be powered both by fuel and compressed air; to also provide a hybrid vehicle, which can be operated using fuel, electricity, and compressed air; to also provide a hybrid vehicle with electric motor in each wheel, which would enable greater maneuverability and would decrease size and weight of the vehicle; and to also provide an automatic parking system for such a hybrid vehicle.

According to an aspect of the invention, this objective is met by the valves being of a rotary type, having a rotation body, such as a sphere, for example. The spherical valves pivot around their axes and thus control the opening and the closing of the intake and exhaust channels. The camshafts forcibly close the valves without requiring springs. This has the effect of making the engine lighter and more durable, reducing its weight and fuel consumption and eliminating improper untimely spontaneous ignition, thus resulting in overall improved power and performance.

According to another aspect of the invention, this objective is met by converting a traditional 4-stroke piston engine into an effectively 2-stroke engine by adding a source of compressed air. Compressed air is delivered from a compressor or a storage tank directly into the combustion chamber and fuel is injected directly into the combustion chamber by fuel injector, thereby eliminating the intake and compression strokes of a traditional 4-stroke engine, leaving only the power and exhaust strokes. Therefore, such a 2-stroke engine would only require exhaust valves, since the need for intake valves would be obviated by direct air injection.

According to another aspect of the invention, this objective is met by the engine being of a rotary type, having a rotation body, such as a cylinder, for example. The rotor of the engine can have at least two vanes. One preferred embodiment, which is illustrated in FIG. 9, comprises two combustion chambers and four vanes. The vanes may be moving radially from within the rotor body, or may be tilted at an angle different from 90°, and their axes do not necessarily have to go through the center of the rotor.

Each pair of vanes and the stator define a rotary combustion chamber and an exhaust chamber. This engine needs no intake or exhaust valves, nor does it need an intake manifold. This engine uses compressed fuel-air mixture (or some other fuel-oxidant mixture), which gets created by having the fuel and compressed air (or another oxidant) delivered separately prior to ignition by their respective injectors into the combustion chamber, where fuel and oxidant (such as air) get mixed immediately prior to combustion.

This has the effect of making the engine smaller, lighter and more durable; reducing fuel consumption; eliminating improper, spontaneous, and untimely ignition; increasing engine torque, speed, and power; decreasing vibration and noise; all of which leads to overall improved performance and increased expected mean time between failures (MTBF).

According to another aspect of the invention, this objective is met by utlizing a Roots-type (also referred to as rotary tooth) supercharging compressor configuration for a rotary internal combustion engine, whereby the lobes (vanes) of the rotor would not be touching the walls of the engine stator (body) when rotating. The lobes could be of various geometric shapes for increased efficiency. There could be a plurality of rotors within a single stator (engine body).

According to another aspect of the invention, this objective is met by combining the internal combustion engine with electric drive and pneumatic drive in a hybrid vehicle, capable of running on fuel, electricity, or compressed air.

According to another aspect of the invention, this objective is met by the hybrid vehicle having a separate electric motor for each wheel, enabling the vehicle to turn each of the wheels up to 90 degrees in either direction, allowing for greater maneuvaribility and substantially decreased size and weight due to the resultant absence of transmission, drive shafts, and other standard equipment, which exists in traditional vehicles.

According to another aspect of the invention, this objective is met by providing an automatic parking system for such a hybrid vehicle, whereby the vehicle's onboard computer program and ancillary equipment, such as video, infrared, utlrasound, radar, or other distance-measuring sensors would guide the vehicle into a parking space with minimal or no operator input.

Further objects of the invention will be brought out in the following part of the specification, wherein detailed description is for the purpose of fully disclosing the invention without placing limitations thereon.

BRIEF DESCRIPTION OF THE DRAWINGS

The invention is explained in more detail with reference to the drawings.

DETAILED DESCRIPTION OF THE PREFERRED EMBODIMENTS

Figure 1:
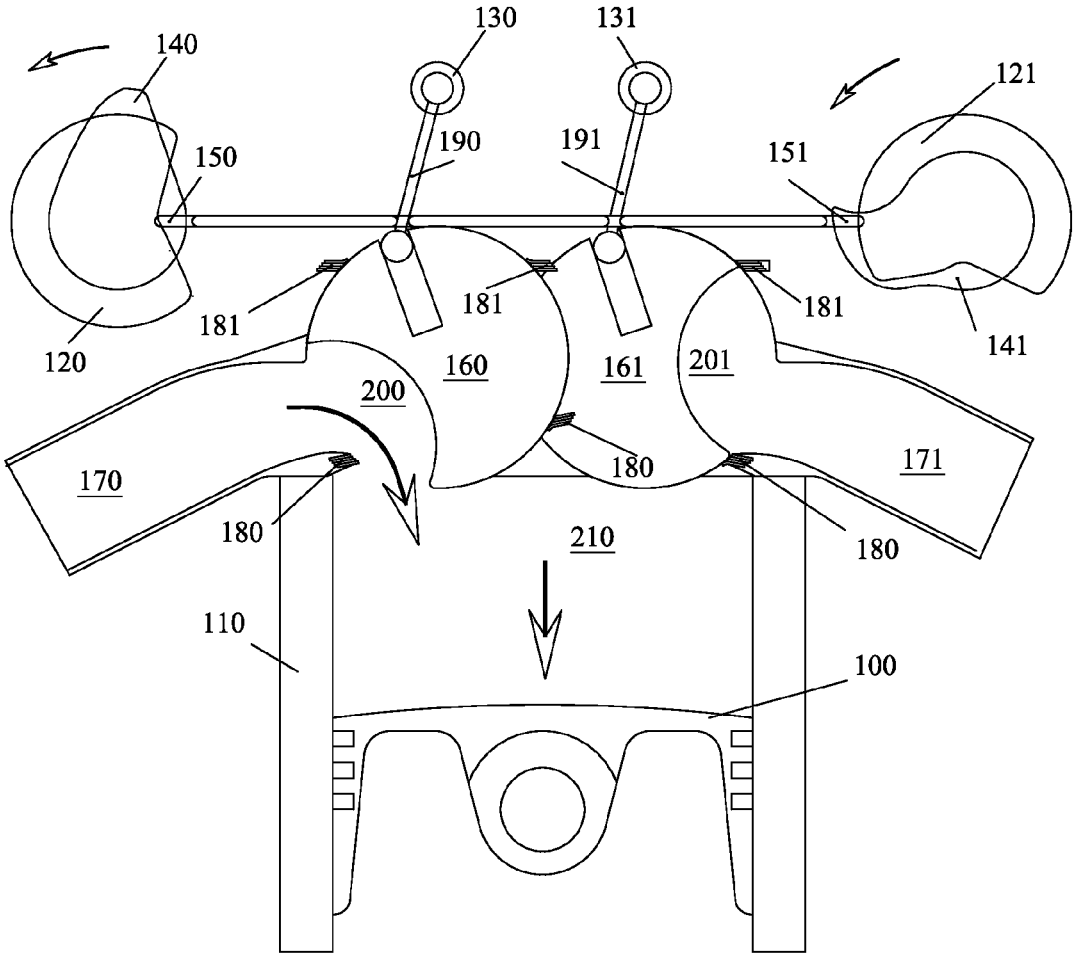
FIG. 1 is a cross-sectional schematic view of an embodiment of the invention, showing the variable pivoting valve mechanism in accordance with one embodiment of the present invention during the intake stroke.

Referring to the drawings, particularly to FIG. 1, which shows a valve, mechanism for a machine such as an internal combustion engine, which requires distribution of gases, a variable pivoting valve mechanism can be seen, wherein valve opening and closing can be achieved by pivoting it by means of a rocker arm and plunger. Gas distribution timing and phases are regulated by moving the axis of the rocker arm. FIG. 1 shows the fuel-air mixture intake stroke, the engine crankshaft (not shown), which, while turning, moves piston 100 down along the axis of cylinder 110, creating low pressure in cavity bore 210 within cylinder 110. Cam 120 of the left distribution camshaft by means of plunger 150 and rocking lever 190 turns intake spherical valve 160 with its intake valve cavity 200 counter-clockwise and opens gas mixture access through intake pipe 170. Thus, gas mixture from intake pipe 170 enters cavity bore 210 of cylinder 110. At the end of the intake stroke of the cycle, cam 120 of the left distribution camshaft by means of plunger 150 and rocking lever 190 turns spherical valve 160 with its valve intake cavity 200 clockwise and closes gas mixture access through intake pipe 170. At the same time, right distribution camshaft is also turning counterclockwise, turning cam 121 with it. However, since the round part of cam 121 moves along the plunger 151, the latter is stationary during the intake stroke of the cycle along with rocking lever 191. Spherical exhaust valve 161 remains closed and stationary throughout the intake stroke of the engine cycle. Profile of cam 141 moves plunger 150 and turns rocking lever 190 around its axis 130. Spherical valve 160 turns inside lower compression O-ring seals 180 and upper compression O-ring seals 181 into the open position. Geometric movement of axis 130 of rocking lever 190 changes phases of intake gas distribution during operation of the engine.

Figure 2:
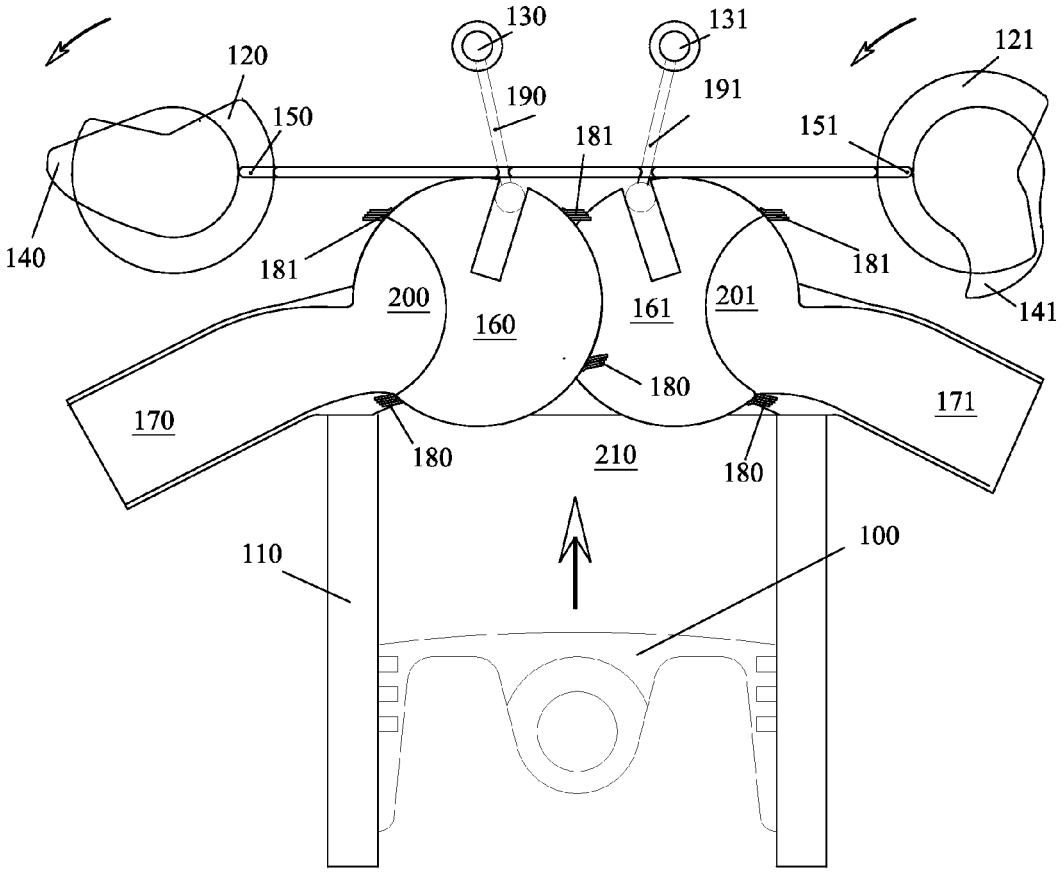
FIG. 2 is a cross-sectional schematic view of an embodiment of the invention, showing the compression stroke.

Referring to FIG. 2, which shows the gas mixture compression stroke, the engine's crankshaft (not shown), while turning, moves piston 100 up along the axis of cylinder 110, creating pressure in cavity 210 of cylinder 110. Intake spherical valve 160 and exhaust spherical valve 161 remain stationary and closed during the compression stroke. Intake pipe 170 and exhaust pipe 171 remain closed. Piston 100 moves up along the axis of the cylinder 110, compressing the gas mixture in cavity 210 of cylinder 110. Gas pressure pushes lower compression O-ring seals 180 towards spherical valves 160 and 161. Valves 160 and 161 are pushed into the saddle inside the body of the engine head (not shown).

Figure 3:
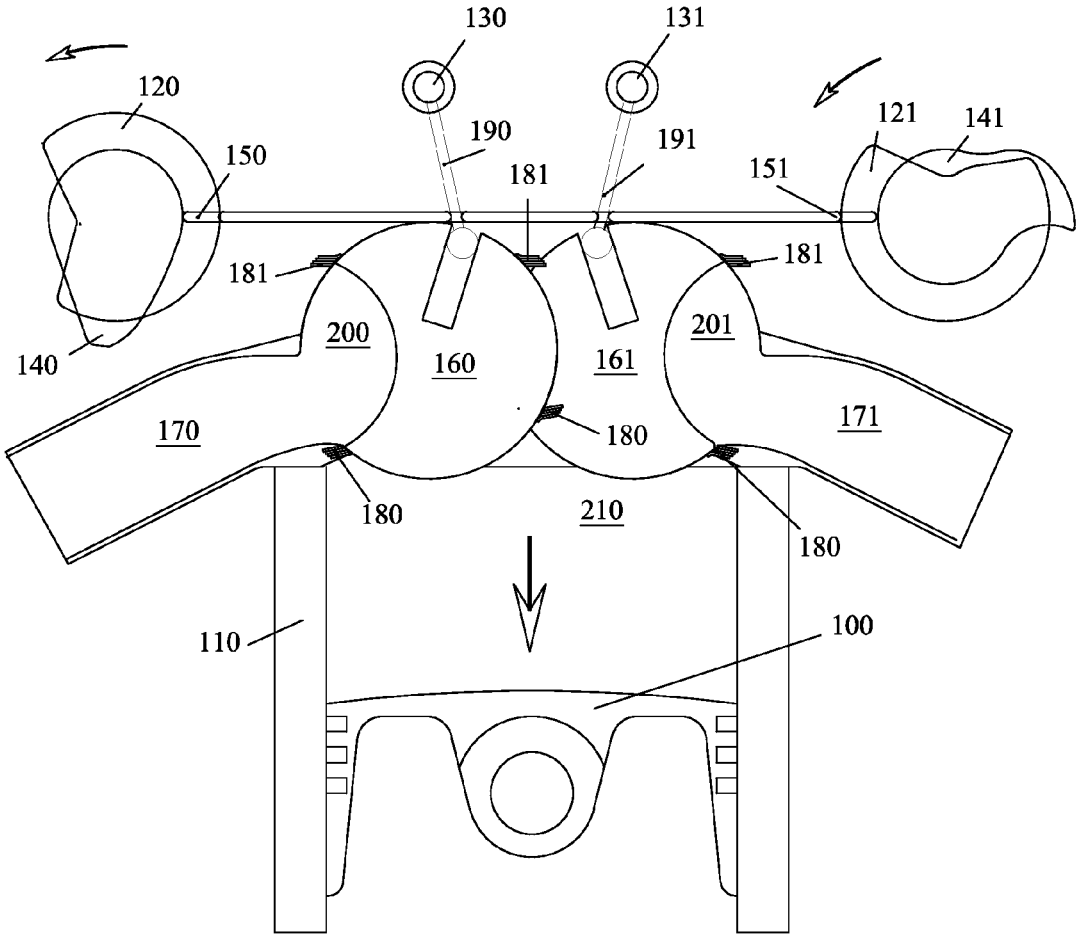
FIG. 3 is a cross-sectional schematic view of an embodiment of the invention, showing the power stroke.

Referring to FIG. 3, which shows the power stroke, valves 160 and 161 are stationary and closed during the stroke. Intake pipe 170 and exhaust pipe 171 are closed. Compressed gas mixture in cylinder cavity 210 explodes. Explosion energy is converted into the downward movement of piston 100.

Figure 4:
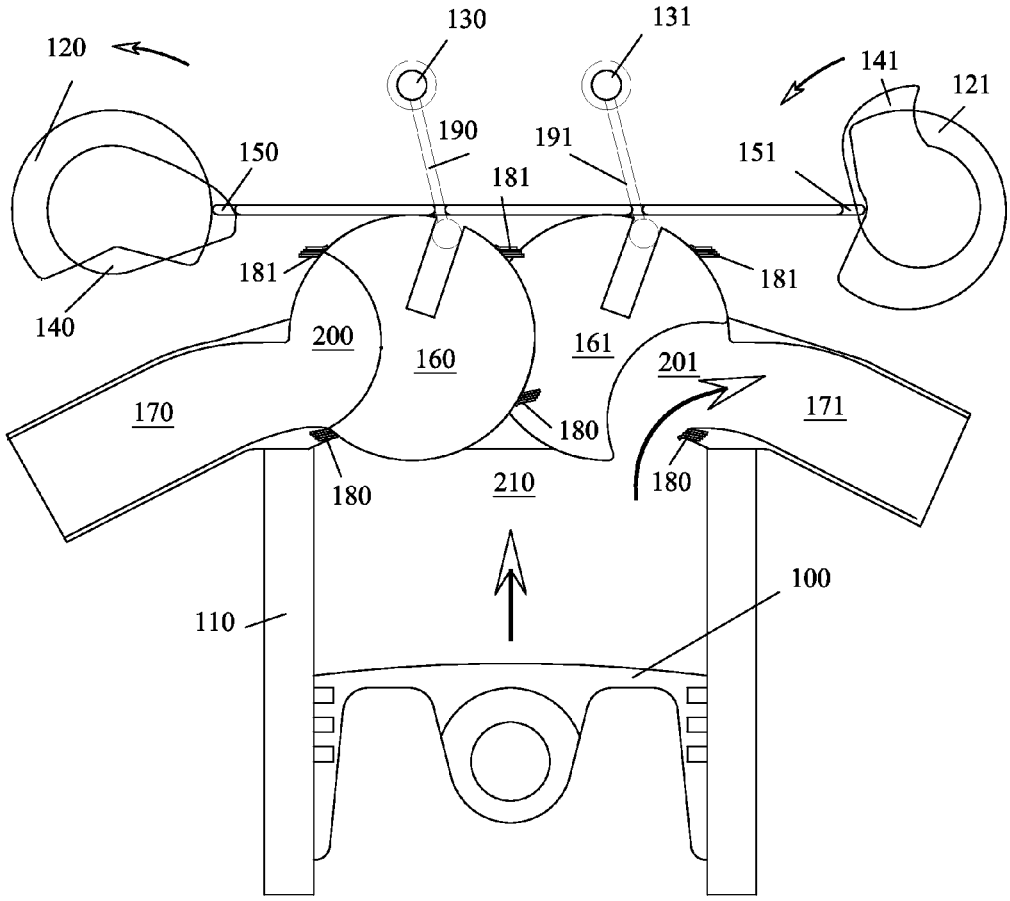
FIG. 4 is a cross-sectional schematic view of an embodiment of the invention, showing the exhaust stroke.

Referring to FIG. 4, which shows the exhaust stroke, piston 100 moves upward along the axis of cylinder 110. Cam 140 of the left distribution camshaft turns valve 161 with its exhaust valve cavity 201 clockwise by means of plunger 151 and rocking lever 191, opening exhaust pipe 171. Exhaust gases exit from cylinder cavity 210 into exhaust pipe 171. At the end of the exhaust stroke, cam 121 of right distribution camshaft by means of plunger 151 and rocking lever 191 turns valve 161 with its exhaust valve cavity 201 counterclockwise and closes gas exhaust from cylinder cavity 210 through exhaust pipe 171. Geometric movement of axis 131 of rocking lever 191 changes phases of exhaust gas distribution during operation of the engine.

Referring to FIGS. 1-4, the axes of rotation 130 and 131 of rocking levers 190 and 191 can be moved left, right, up or down to change the timing of the opening and the closing of the valves. For example, if axis 130 is moved to the left, then the timing of the opening and the closing of intake valve 160 is advanced. If axis 130 is moved to the right, then the timing of the opening and the closing of intake valve 160 is retarded. If axis 130 is moved up, then the angle of the opening and the closing of intake valve is decreased. If axis 130 is moved down, then the angle of the opening and the closing of intake valve is increased.

Figure 5:
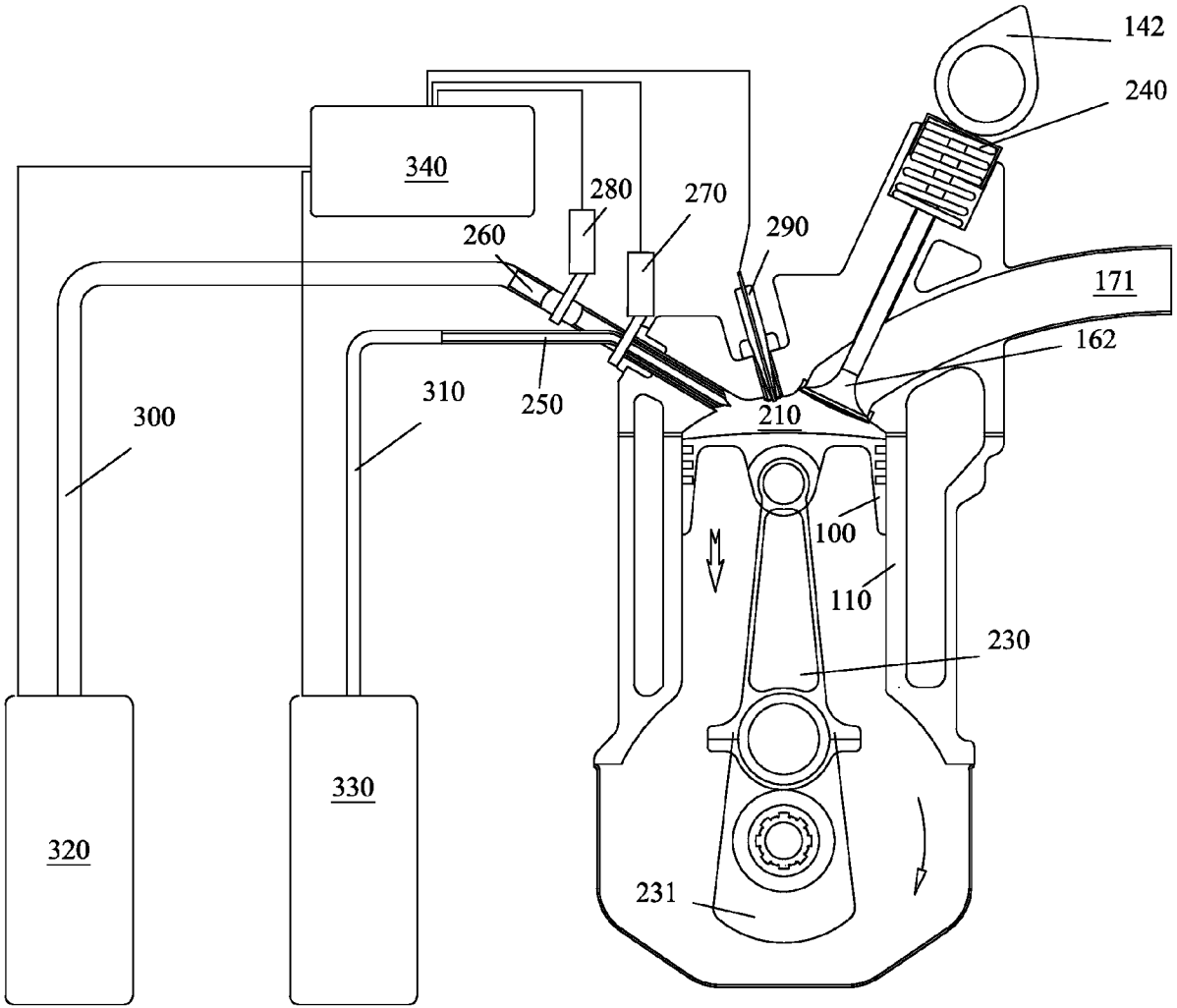
FIG. 5 is a cross-sectional schematic view of an embodiment of the invention, showing the converted 2-stroke internal combustion engine with poppet valves.

Referring to FIG. 5, which shows a conventional 4-stroke internal combustion engine converted into a 2-stroke one, it can be see that this engine has no intake valve or intake manifold. The compression of gas and fuel mixture is accomplished outside the engine by means of fuel pump 330 and air compressor 320, which inject fuel and compressed air into the combustion chamber, forming a compressed fuel-air mixture immediately prior to combustion. FIG. 5 shows cross-section of the converted 2-stroke internal combustion engine, consisting of engine cylinder body 110, crankshaft 231, piston 100, poppet valve 162, cam 142, and valve spring 240, where crankshaft 231 moves within engine body 110 clockwise (in this embodiment). Fuel is delivered from fuel pump 330 through fuel line 310 and fuel injection control valve 270 into combustion chamber 210 via fuel injector 250. Air is delivered from air compressor 320 through compressed air line 300 and air injection control valve 280 into combustion chamber 210 via compressed air injector 260. Fuel-air mixture is ignited by spark plug 290 and is combusted in chamber 210, after which exhaust gases are forced out of the engine through exhaust valve 162 and via exhaust manifold 171. Changes in amounts and pressure of fuel and air (or any other oxidant), which are injected into combustion chamber 210, are accomplished by electronic control unit 340, which controls all modules with electrical interfaces and which may be implemented as fuel injection controller, or which may be an integral part of an onboard computer responsible for overall control of the engine or the system.

Power Stroke

When piston 100 is at the upper dead center position inside cylinder 110, exhaust valve 162 is fully closed, and air/oxidant is injected under pressure via air injection control valve 280 and air injector 260 into the combustion chamber 210. At about the same time, fuel is injected through fuel injection control valve 270 and fuel injector 250 into the combustion chamber 210. This creates a compressed fuel-air mixture in the combustion chamber 210. This mixture is then ignited, either by means of spark plug 290 (in case of gasoline engines, for example), or by the pressure itself (in case of Diesel engines, for example). The force of the explosion makes piston 100 move downwards, which makes piston rod 230 go down as well, thereby turning crankshaft 231, thus translating linear motion of piston 100 into rotational motion of crankshaft 231.

Exhaust Stroke

After piston 100 reaches bottom dead center inside cylinder 110, exhaust valve 162 is opened, piston 100 begins to move upward, forcing the exhaust gases out of cylinder 110 through exhaust valve 162 and exhaust manifold 171. This process continues until piston 100 reaches top dead center and exhaust valve 162 is closed, thereby finishing exhaust stroke and starting power stroke.

Figure 6:
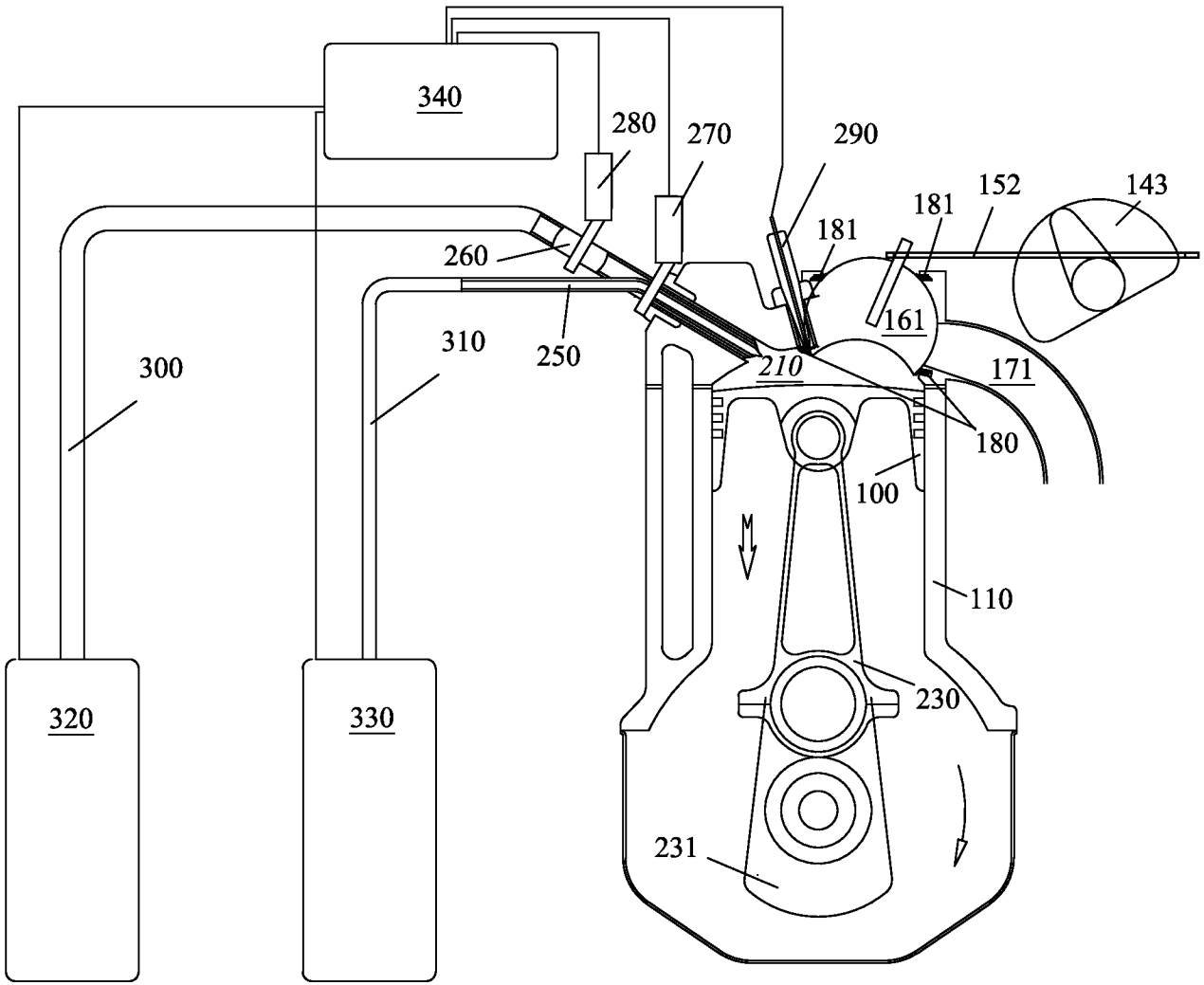
FIG. 6 is a cross-sectional schematic view of an embodiment of the invention, showing the converted 2-stroke internal combustion engine with spherical valves.

Referring to FIG. 6, which shows cross-section of the converted 2-stroke internal combustion engine with spherical valves, this embodiment is essentially similar to the one shown in FIG. 5, except that instead of poppet valve 162 this embodiment has spherical valve 161; instead of cam 142 this embodiment has a different cam 143; and instead of spring 240 this embodiment has plunger 152, connecting spherical valve 161 with cam 143.

Figure 7:
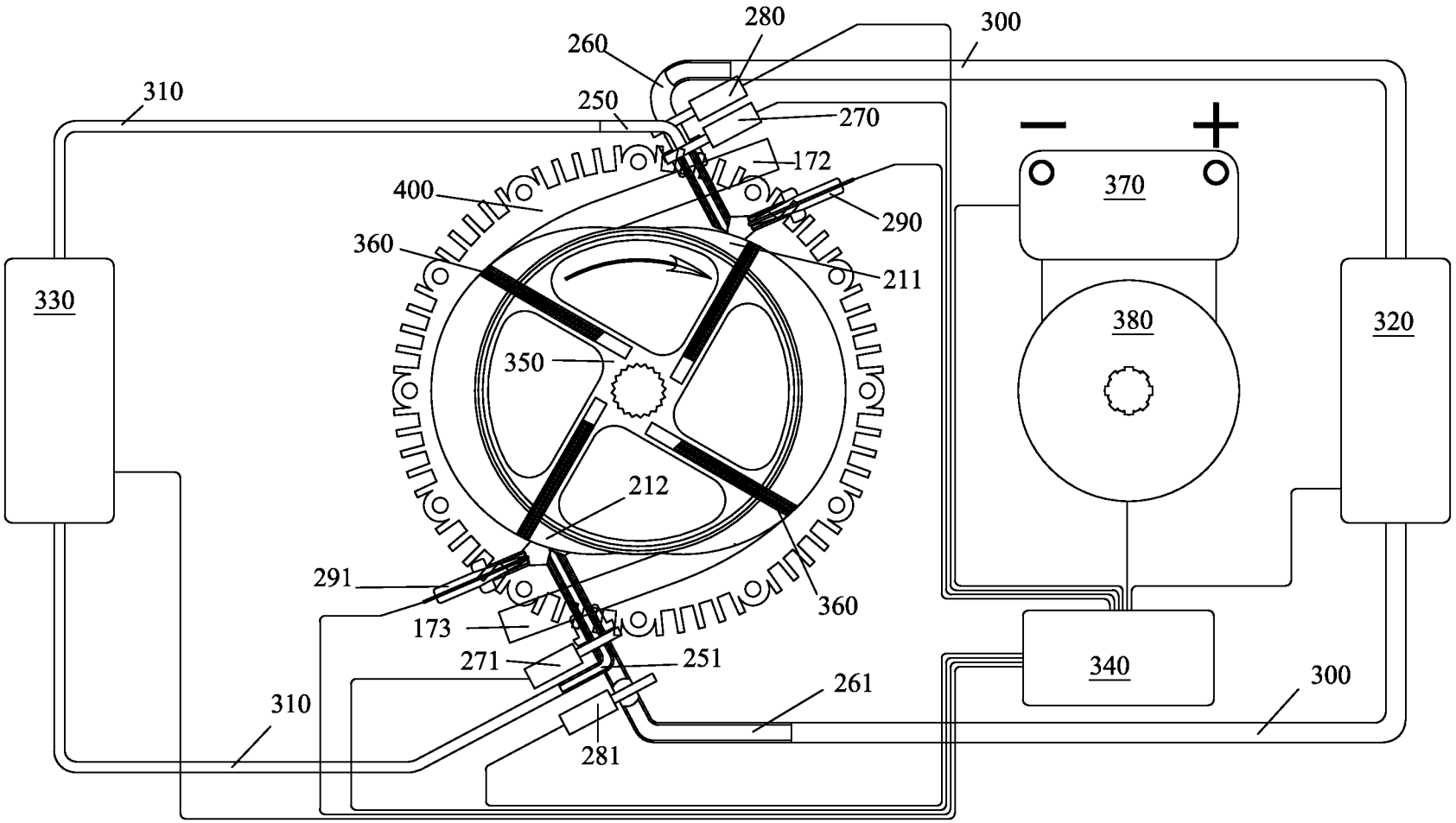
FIG. 7 is a cross-sectional schematic view of the rotary engine mechanism with appurtenant apparatus according to one embodiment of the invention.

Referring to FIG. 7, which shows a rotary internal combustion engine, it can be seen that the engine has no intake or exhaust valves. The compression of gas and fuel mixture is accomplished outside the engine by means of fuel pump 330 and air (or another oxidant) compressor 320, which separately inject compressed fuel and air (or some other oxidant) into combustion chamber(s) 211 and/or 212. FIG. 7 shows cross-section of the rotary internal combustion engine with appurtenant apparatus, where rotor 350 consists of a rotation body, such as, for example, a cylinder, which has, in this particular embodiment, four radially moving vanes 360. In this particular embodiment, rotor 350 moves within engine body 400 (stator) clockwise. Fuel is delivered through line(s) 310 and into combustion chamber(s) 211 and/or 212 through fuel injection control valve(s) 270 and/or 271 and via fuel injector(s) 250 and/or 251. Air (or another oxidant) is delivered through line(s) 300 and into combustion chamber(s) 211 and/or 212 through air injection control valve(s) 280 and/or 281 via air injector(s) 260 and/or 261. Fuel-air mixture is ignited by spark plug(s) 290 and/or 291 and is combusted in combustion chamber(s) 211 and/or 212. After fuel-air mixture is combusted, exhaust gases are forced out of the engine via exhaust duct(s) 172 and/or 173. Electric motor 380 serves as starter motor as well as generator, and may serve as compressor motor for fuel and/or air (or another oxidant). Rotor vanes 360 radially move in and out of rotor 350 depending on their position in engine body 400. Vanes 360 may be pushed out of rotor 350 by means of springs or compressed air, or by some other means so as to seal against engine body 400 at low rotational speed. As the RPM increases, the centrifugal forces will force the vanes out. Changes in amounts and pressure of fuel and air, which are injected into combustion chamber(s) 211 and/or 212, are accomplished by electronic control unit 340, which may be implemented as fuel injection controller or may be an integral part of an onboard computer responsible for overall control of the system. Present invention may have different embodiments employing at least one combustion chamber with at least two vanes.

Start-Up and Idling Mode of Operation

Battery 370 supplies electrical current to electrical motor 380, which turns rotor 350, air compressor 320, and fuel pump 330. Air or another gaseous oxidant necessary for combustion is delivered from air compressor 320 via compressed oxidant line 300 through air injection control valve 280 into injector 260, which delivers it into combustion chamber 211. Fuel is delivered from fuel pump 330 via fuel line 310 through fuel injection control valve 270 into fuel injector 250 and injected into combustion chamber 211. Ignition is accomplished by means of spark plug 290 in case of fuels requiring means of ignition, or by self-combustion due to Diesel effect. During the idling mode it is possible to only use one spark plug 290, one fuel injector 250, and one air injector 260. The periodicity of activation of spark plug 290, fuel injection control valve 270, air injection control valve 280, fuel injector 250, and air injector 260 is once per 180° turn of rotor 350.

Operation Under Low Load at Low RPM

Rotor 350 or electric motor 380 turns air compressor 320 and fuel pump 330. Compressed air (or some other gaseous oxidant) is delivered via compressed air lines 300, air injection control valves 280 and 281, and through air injectors 260 and 261 into combustion chambers 211 and 212. Fuel is delivered via fuel lines 310, through fuel injection control valves 270 and 271, and through fuel injectors 250 and 251 into combustion chambers 211 and 212. Ignition is accomplished by spark plugs 290 and 291. During low load operation spark plugs 290 and 291, fuel injection control valves 270 and 271, air injection control valves 280 and 281, fuel injectors 250 and 251, and air injectors 260 and 261 are operated periodically, once per 180° turn of rotor 350.

Operation Under Full Load at High RPM

This is similar to operation under low load at low RPM, except that during full load operation spark plugs 290 and 291, fuel injection control valves 270 and 271, air injection control valves 280 and 281, fuel injectors 250 and 251, and air injectors 260 and 261 are operated twice as frequently, once per 90° turn of rotor 350.

Figure 8:
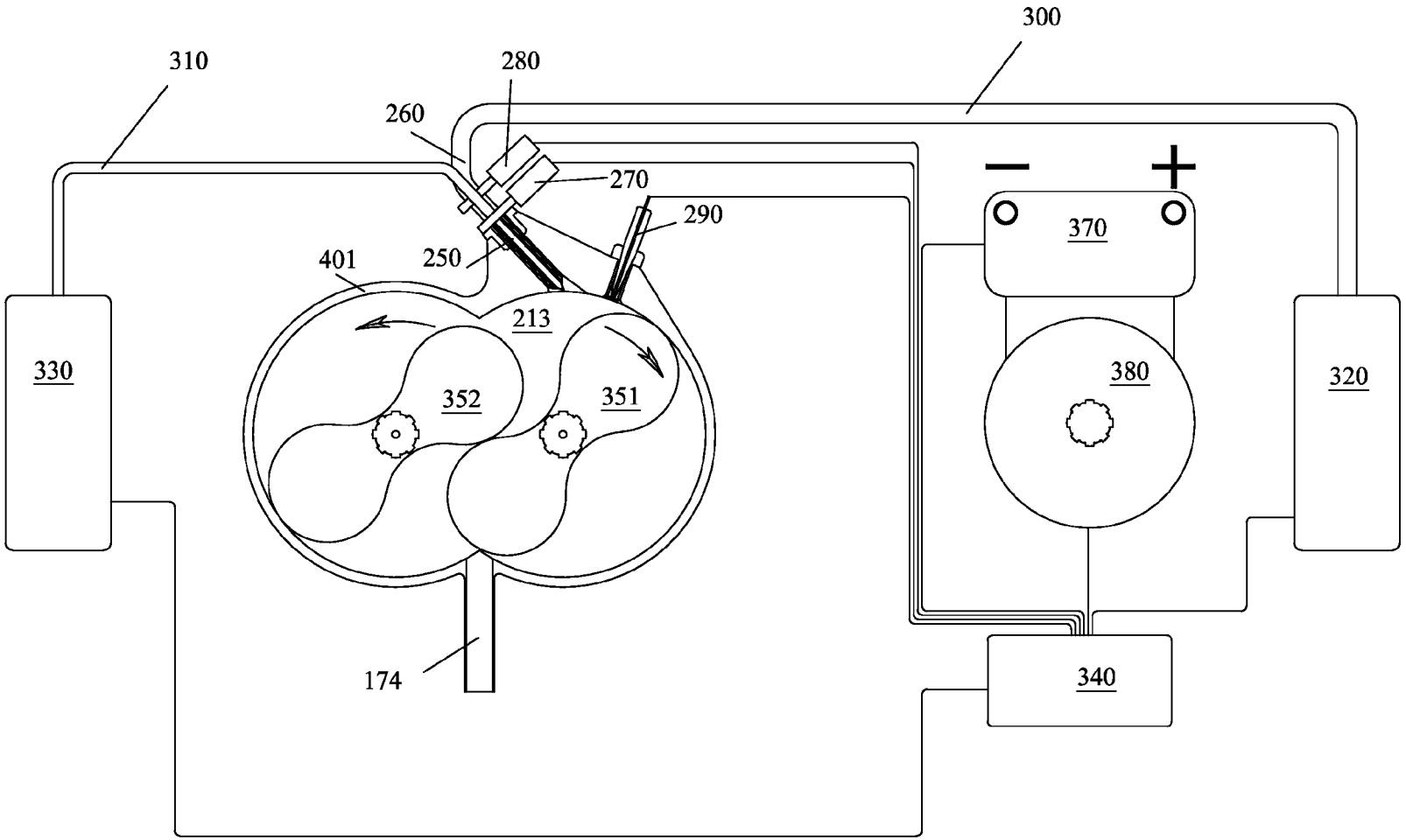
FIG. 8 is a cross-sectional schematic view of another embodiment of the rotary engine with two rotors, each having two lobes.

Reference is made to FIG. 8, which shows another embodiment of the rotary engine with two rotors 351 and 352 within stator 401, each having two lobes, rotor 351 is leading and rotor 352 is following. There is a single combustion chamber 213 and a single exhaust pipe 174, with all the other appurtenant parts being the same or essentially similar to those shown in FIG. 7. The principle of operation of this embodiment is similar to the one shown in FIG. 7 under its start-up, idling, and low load modes of operation.

Figure 9:
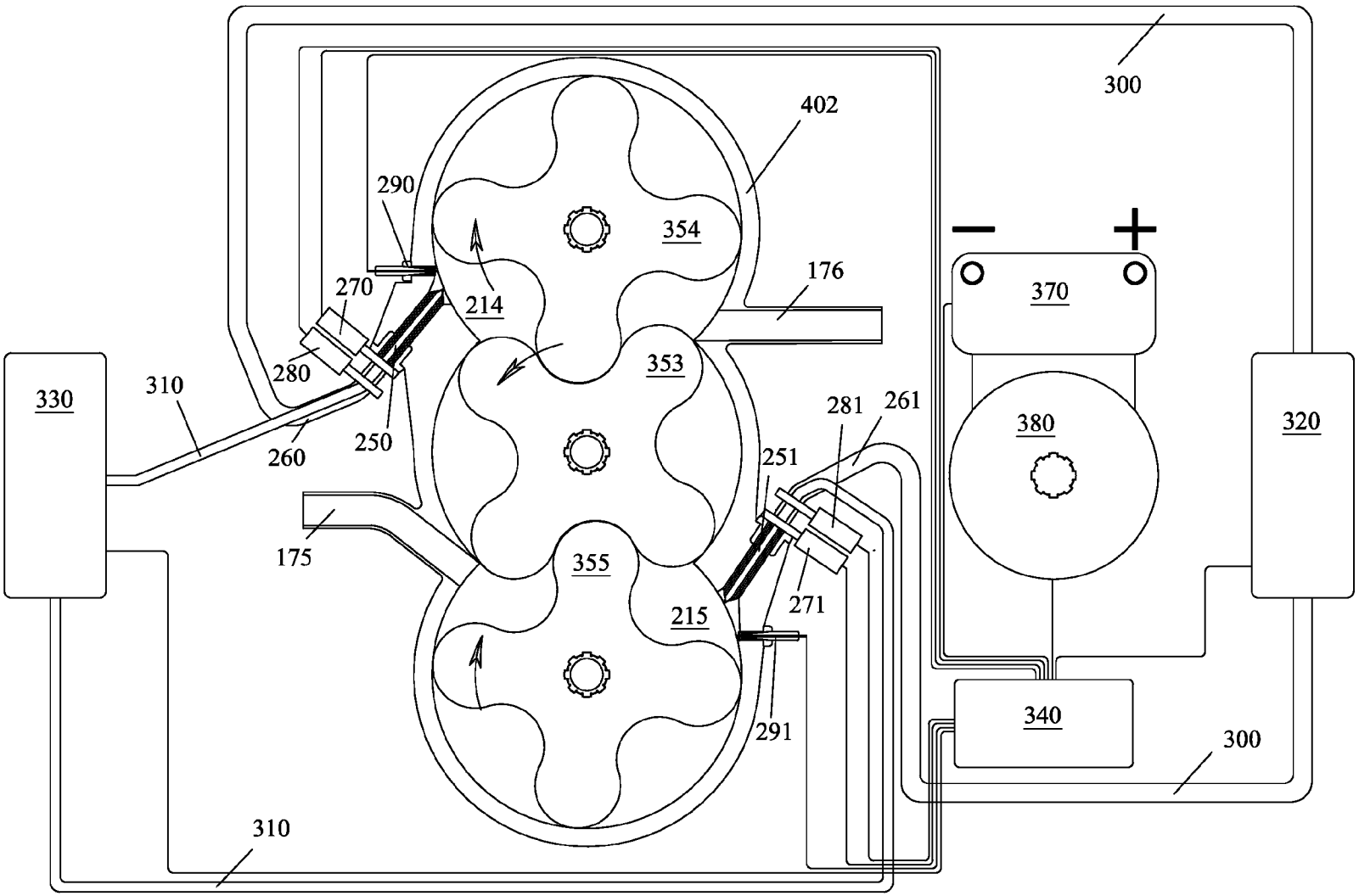
FIG. 9 is a cross-sectional schematic view of another embodiment of the rotary engine with three rotors, each having four lobes.

Reference is made to FIG. 9, which shows another embodiment of the rotary engine with stator 402 and three rotors 353, 354, and 355, each rotor having four lobes, with rotors 354 and 355 leading and rotor 353 following. There are two combustion chambers 214 and 215, and two exhaust pipes 175 and 176. In most other respects and principles of operation, this embodiment is essentially similar to that shown in FIG. 7.

Figure 10:
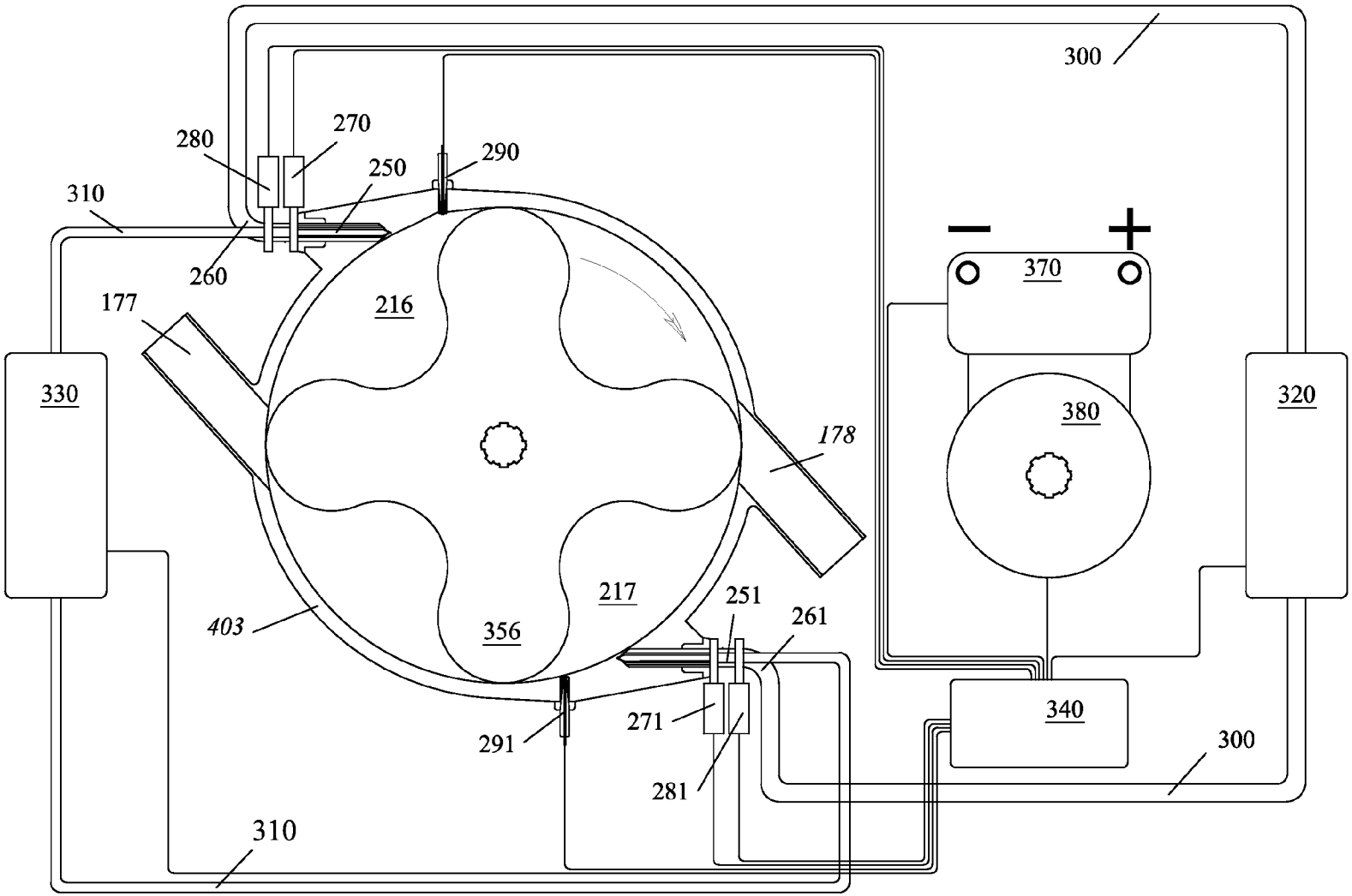
FIG. 10 is a cross-sectional schematic view of another embodiment of the rotary engine with one rotor with four lobes.

Referring to FIG. 10, which shows another embodiment of the rotary engine with stator 403, one rotor 356 with four lobes, two combustion chambers 216 and 217, and two exhaust pipes 177 and 178, it can be said that with the exception of rotor 356 itself, in most other respects and principles of operation this embodiment is essentially similar to that shown in FIG. 7.

Similar to the embodiment shown on FIG. 7, embodiments shown on FIGS. 9 and 10 can be tuned to run with one or both sets of fuel injection and combustion equipment working, depending on the load and power requirements, or with one or both sets supplying only compressed air, as when used, for example, in a hybrid vehicle.

Figure 11:
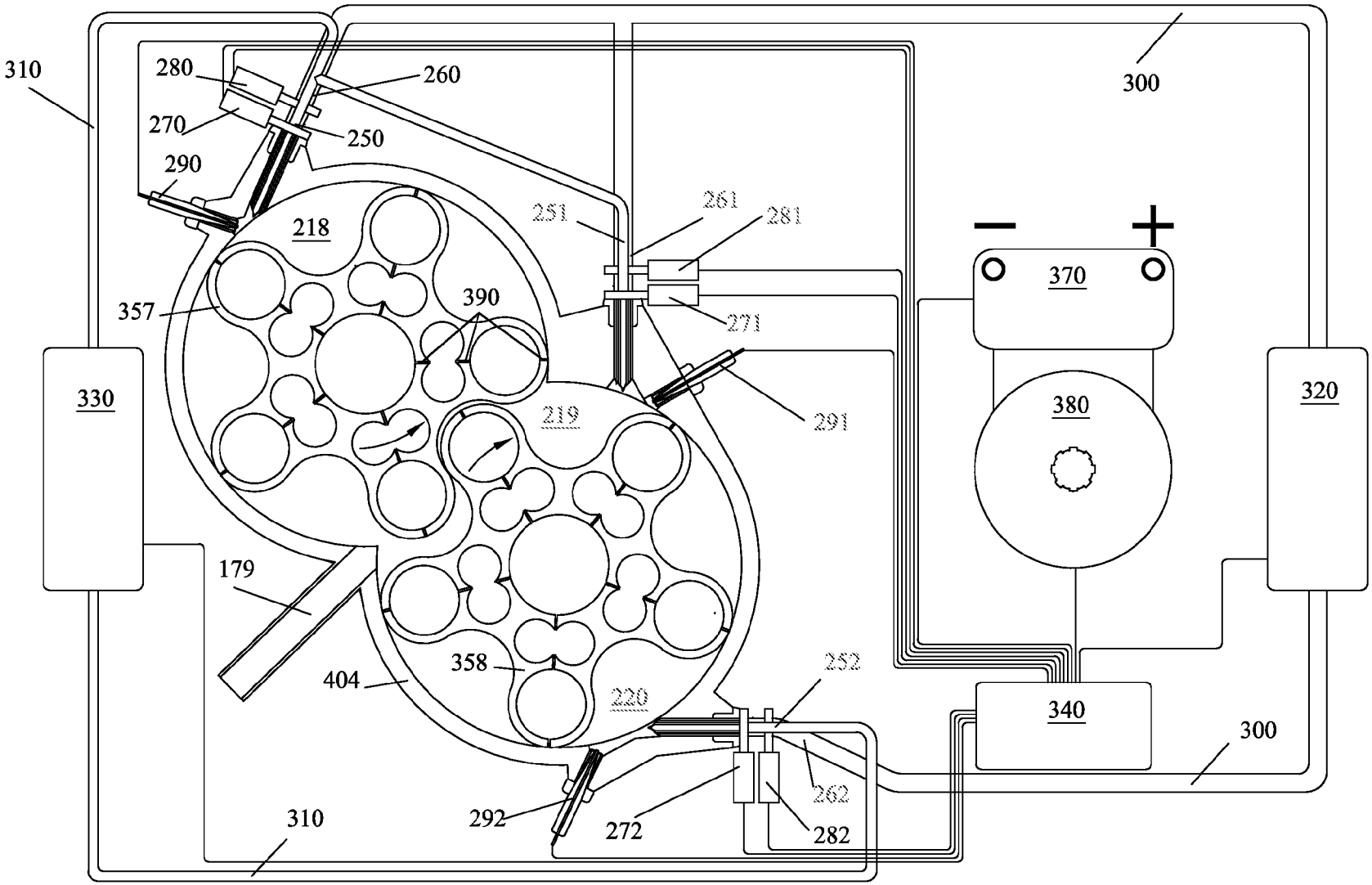
FIG. 11 is a cross-sectional schematic view of another embodiment of the rotary engine with two rotors, each having five lobes.

Reference is made to FIG. 11, which shows another embodiment of the rotary engine with stator 404 and two rotors 357 and 358, each having five lobes. In this embodiment, there are three combustion chambers, 218, 219, and 220, all leading to a single exhaust pipe 179. There are three sets of combustion equipment, consisting of fuel injection control valves 270, 271, and 272; air injection control valves 280, 281, and 282; fuel injectors 250, 251, and 252; air injectors 260, 261, and 262; and spark plugs 290, 291, and 292. In most other respects and principles of operation, this embodiment is essentially similar to that shown in FIG. 7.

Another distinct feature of this embodiment, which is different from other shown embodiments, is radiating air ducts 390 of small diameter passing through each of the five lobes of each of the two rotors 357 and 358, emanating from the center of each rotor. These air ducts 390, which could be less than 1 mm in diameter, deliver compressed air from air compressor 320 via compressed air line 300, enter the housing of stator 404 and are connected to each of the hollow rotor axles, from which the air spreads through inside of the rotors, cooling them, and exiting the rotors into the inside of the stator, cooling the inner surfaces of stator 404. This serves as the cooling system of the rotary engine in this particular embodiment, which may totally obviate the need for liquid cooling.

Yet another distinct feature of this embodiment is the way the three sets of air and fuel combustion equipment—namely, the air and fuel injectors and control valves, as well as the spark plugs—are used. These could be configured in such a way as to deliver the air and fuel only into the middle combustion chamber 213, while the other two combustion chambers 211 and 212 would only be supplied with compressed air.

This would serve to complete the combustion of the unburned air and fuel mixture, coming from the middle combustion cavity 213, as well as to cool rotors 357 and 358, and stator 404.

Alternatively, all three combustion cavities in the embodiment shown in FIG. 11 could be used to inject air and fuel, thereby increasing the output power by about a factor of three as compared to the previous example. There could also be other embodiments providing useful combinations of the combustion equipment controlled by controller 340. For example, yet another, fourth set of combustion equipment (injectors, valves, spark plug) could be added to the shown configuration, creating another combustion chamber so as to increase the total output power of the engine.

In general, the greater the number of combustion chambers, the greater the power output of the rotary engine. The number of combustion chambers may be increased by increasing the number of rotors and/or the number of rotor lobes per rotor. Furthermore, rotary engine modules of any of the above designs could be stacked together to provide even higher output power, if desired.

What is claimed is:

1. An internal combustion engine system including:

a combustion chamber of a rotary internal combustion engine;

at least one channel for discharging exhaust gas out of said combustion chamber; and a direct oxidant injection mechanism having a controlled flow-regulating oxidant-pressurizing appurtenance arranged for directing externally pressurized oxidant into said combustion chamber, wherein said externally pressurized oxidant is injected into said combustion chamber near a location of a fuel injector for injecting fuel into said combustion chamber, so that said fuel and said pressurized oxidant are rapidly mixed together;

wherein said appurtenance includes a mobile member within said combustion chamber, and wherein said mobile member is at least one rotor of said rotary internal combustion engine.

2. A direct oxidant injection mechanism for a combustion chamber of an internal combustion engine, said mechanism comprising:

at least one channel for directing oxidant into said combustion chamber;

an oxidant-pressurizing appurtenance connected to said oxidant-directing channel, wherein said appurtenance is oriented to direct externally pressurized oxidant through said channel and to inject said pressurized oxidant directly into said combustion chamber;

wherein said appurtenance includes a mobile member within said combustion chamber, wherein said combustion chamber is a combustion chamber of a rotary internal combustion engine; and wherein said mobile member is at least one rotor of said internal combustion engine;

a first flow regulator for controlling entry of said pressurized oxidant into said combustion chamber;

at least one channel for directing fuel into said combustion chamber;

a second flow regulator for controlling entry of said fuel into said combustion chamber, wherein said second flow regulator is oriented to facilitate fuel entry proximate to oxidant injection, and wherein said fuel is injected into said combustion chamber while said externally pressurized oxidant is injected into said combustion chamber; and at least one channel for discharging exhaust gas out of said combustion chamber.

3. The direct oxidant injection mechanism according to claim 2 wherein said appurtenance includes a gas compressor.

4. The direct oxidant injection mechanism according to claim 2 wherein said first flow regulator includes an intake valve near said combustion chamber for controlling entry of said pressurized oxidant into said combustion chamber.

5. The direct oxidant injection mechanism according to claim 2 wherein said second flow regulator includes an intake valve near said combustion chamber for controlling entry of said fuel into said combustion chamber.

6. The direct oxidant injection mechanism according to claim 2 wherein said first flow regulator includes an intake valve interfacing between said first channel and said combustion chamber for controlling entry of said pressurized oxidant into said combustion chamber.

7. The direct oxidant injection mechanism according to claim 2 wherein said second flow regulator includes an intake valve interfacing between said second channel and said combustion chamber for controlling entry of said fuel into said combustion chamber.

8. The direct oxidant injection mechanism of claim 2, wherein said at least one rotor has at least two lobes, which respectively have a small clearance between said lobes and interior surfaces of said combustion chamber.

* * * * *